United States Patent [19]

Young

[11] 4,262,712

[45] Apr. 21, 1981

[54] MAGNETICALLY LATCHABLE LIQUID DISPENSING NOZZLE

[75] Inventor: Dale A. Young, Bridgewater, N.J.

[73] Assignee: Exxon Research & Engineering Co., Florham Park, N.J.

[21] Appl. No.: 958,735

[22] Filed: Nov. 8, 1978

[51] Int. Cl.[3] ..... B65B 31/00; B67C 3/28

[52] U.S. Cl. ..... 141/392; 137/615; 141/DIG. 1

[58] Field of Search ..... 141/DIG. 1, 392, 383, 141/384, 97; 137/615

[56] References Cited

U.S. PATENT DOCUMENTS

| | | | |
|---|---|---|---|
| 3,148,713 | 9/1964 | Jones | 141/DIG. 1 |
| 3,316,514 | 4/1967 | Radus et al. | 335/291 |
| 3,566,928 | 3/1971 | Hansel | 141/97 |
| 3,724,499 | 4/1973 | Huniu | 137/615 |
| 3,995,669 | 12/1976 | Weidenaar et al. | 141/392 |
| 3,995,670 | 12/1976 | Weidenaar et al. | 141/392 |
| 4,060,110 | 11/1977 | Bower | 141/DIG. 1 |

FOREIGN PATENT DOCUMENTS

| | | | |
|---|---|---|---|
| 1163062 | 2/1964 | Fed. Rep. of Germany | 141/383 |

*Primary Examiner*—William D. Martin, Jr.
*Attorney, Agent, or Firm*—F. Donald Paris; Eugene Zagarella, Jr.

[57] ABSTRACT

A gasoline dispensing nozzle is magnetically held in place to the fueling filler neck of the vehicle, while at the same time providing for a tight seal at the nozzle filler neck interface preventing escape of vapors to the atmosphere. Vapor directional control means may be included in the nozzle or be operably associated therewith, which will permit the recovery or redirecting of gasoline vapors issuing from the vehicle fuel tank during the refueling process. At the filler end of the nozzle is a switchable permanent magnet to latch, support and hold the nozzle to the vehicle fillpipe. To remove the nozzle when refueling is completed, the magnetic flux is switched in a different direction away from the fillpipe to a metal element known as a keeper. A pressure sensing mechanism is provided at the outer face of the magnet so that when a suitable seal is made between the nozzle magnet and the filler neck surface, a signal is provided via the pressure sensor that the seal has been made. The nozzle is designed to have a forward portion which swivels or pivots about an axis on the rear portion of the nozzle. The forward portion, i.e. torque arm, is relatively short in length and provides a minimum amount of moment arm with respect to the axis so that minimum peel forces are generated by the weight of nozzle and hoses which permits smaller size magnets to be utilized.

17 Claims, 14 Drawing Figures

MAGNETICALLY LATCHABLE LIQUID DISPENSING NOZZLE

BACKGROUND OF THE INVENTION

The present invention relates to a nozzle for dispensing a liquid and more particularly to an improved liquid dispensing nozzle which can be magnetically latched to a fillpipe. Moreover, the present invention relates to an improved liquid dispensing magnetically latchable nozzle for control of refueling vapors.

In a preferred embodiment the nozzle is used for dispensing gasoline to a vehicle fuel tank and may include or be associated with means for directing vapors issuing from the fuel tank during refueling, and at least preventing their escape to the atmosphere.

The current air pollution abatement program contemplates specifying that during the refueling process of automobile and other vehicular gas tanks that the displaced vapors which are generated as the tanks are filled are to be recovered, such as by directing them to an on-board vehicle system where they are consumed or by returning them through the nozzle or otherwise to the supply tank. In order to achieve a relatively high degree of collection of the vapors, it is necessary to provide a tight seal between the gas dispensing nozzle and the filler neck of the vehicle fuel tank. Various attempts at accomplishing this have been tried; however, current designs rely primarily and solely on mechanical means for supporting, locking and holding the nozzle to the filler neck to obtain a mechanically tight seal. Typical prior art approaches for providing the seal include spring loaded seals and rubber bellows. Other prior art locking mechanisms for the nozzle include latching ferrules, hook-expanding toggles and U.S. Pat. Nos. 3,995,669 and 3,995,670 disclose improved liquid gas dispensing nozzles including vapor recovery means. The nozzle is locked and secured in place with respect to the filler neck by means of a spring which lockingly engages the perimeter of the neck upon insertion of the nozzle therein. At the outer end of and surrounding the gas dispensing nozzle is a magnetic seal means for providing a suitable seal for the nozzle in order that the vapors are prevented from escaping to the atmosphere and directed to an on-board vehicle system for handling of the vapors or back to the gasoline source i.e., the underground tank at the service station. Another prior art attempt is disclosed in U.S. Pat. No. 3,566,928, wherein a flexible bellows is employed to collect the vapors and the gas dispensing nozzle is mechanically secured in place in a manner similar to that for the aforediscussed patents. The seal for insuring that the vapors are collected is provided by magnetic rubber which contacts the outer extremity of the filler neck. In each of the aforementioned prior art instances the nozzle is held in place by mechanical means and each of the nozzles basically comprises a typical single non-swivel-type structure. The magnet in the aforementioned cases serves only to assist in the attachment of the rubber boot to the fillpipe. In German Pat. No. 1,163,062 the electromagnetically held nozzle is not articulated, nor does it rely on indirected flux to accomplish the attach-release operation according to the present invention.

Another problem of the prior art is that since filler sizes, designs and configurations vary quite widely between the various automobile makes and models, mechanical interlocks and tight vapor seals have only been successful on a select percentage of the present car population. A reason for this is that since the mechanical interlocks require latching to the filler neck gas cap lip, many of the cars have internal filler lips, while others have external lips, screw threads or no lips at all. This lack of standardization is a main cause for low vapor recovery efficiencies of current nozzle designs when the nozzle is self-supported and the filler neck has external lips, screw threads or no lips at all. It is, therefore quite apparent that gasoline dispensing nozzles must be adaptable to all fill neck designs.

SUMMARY OF THE INVENTION

The present invention provides an improved liquid (such as gasoline) dispensing nozzle wherein the nozzle is basically comprised of two relatively articulated portions including a rear and forward portion, the latter being the torque or moment arm being relatively short in distance or length. The moment arm includes at its extremity from which extends the liquid filling nozzle, a permanent magnet for securing the nozzle in place to the filler neck of the vehicle. The magnetic latching will eliminate or at least substantially decrease the number of no fits and increase system recovery efficiency when vapor recovery is desired. Since almost all fillpipes are steel, the magnet will attach, support and lock the nozzle to the fillpipe when desired. A no-seal, no-flow pressure sensing mechanism is provided for determining when there is a proper seal between the fillpipe neck and the nozzle so that if desired or required vapor recovery can be accomplished in highly efficient manner. By vapor recovery it is meant that the vapors emitted during filling of the tank can be directed to a desired location, whether it be on-board the vehicle being filled or back to the source of the liquid or to some other location where they can be retained or properly handled or disposed of. The magnetic attraction between the magnet and the fillpipe will form an inherently tight seal when a compressible rubber face is disposed as the magnet to compensate for fillpipe lip irregularities. In accordance with the present invention, need for mechanical locking dependency on engagement of the nozzle with the fill cap lid locking mechanism is overcome. The present nozzle provides as an integral part thereof a permanent magnet to accomplish such interlocking. The magnet can be released from the fillpipe by redirecting the magnetic flux path from the fillpipe to a keeper via a mechanical or electrical switch so that the nozzle can then be removed from the vehicle. A liquid dispensing nozzle according to the present invention will fit variations in diameter sizes of filler necks by providing a relatively wide flange magnetic surface for coaction with the various sized filler neck surfaces. The no-seal, no-flow feature is accomplished by the force of the magnet against the filler neck which provides a signal that a proper seal is made and permits the fuel valve to open on demand. The nozzle also includes flow control gasoline and vapor control valves in their respective passageways, which can be of the switchable magnet type and are operated electrically to permit the flow of gasoline or other liquid and the collected vapors if vapor recovery is through the nozzle. Another feature is that the rate of fuel dispensed can be controlled at the varying rates by means of appropriate valves or can have a wide range by providing a variable valve orifice. An automatic fill shutoff feature can be incorporated into the nozzle by means of a pressure actuated diaphragm which is responsive to the gasoline level in the tank. This pressure signal for automatic shutoff can also be received by a pressure responsive switch. A variety of suitable electronic liquid level sensing devices can be used to perform this function. A back-up to the afore described automatic fill shutoff is to provide an automatic back pressure shutoff if the nozzle flow control valves in the event that vapor evacuation of the tank is blocked as it is displaced by fuel which otherwise could result in overpressurization and tank rupture. An electronic pressure switch can be arranged to sense the back pressure and shutoff the nozzle. In this embodiment the vapors would be precluded from passing through the forward swivel portion of the nozzle and could upon exceeding a preset pressure level escape to the atmosphere through a pressure relief valve mounted in the forward portion.

Having in mind the foregoing, which will be evident from an understanding of the disclosure, the invention comprises the combination, arrangement and parts disclosed in the presently preferred embodiment of the invention which is hereinafter set forth in such detail as to enable those skilled in the art readily to understand the function, operation, construction and advantages of it when read in conjunction with the accompanying drawings.

DESCRIPTION OF THE PREFERRED EMBODIMENT

Figures 1, 4, 4A, 5, 6, 7, 8, 9:
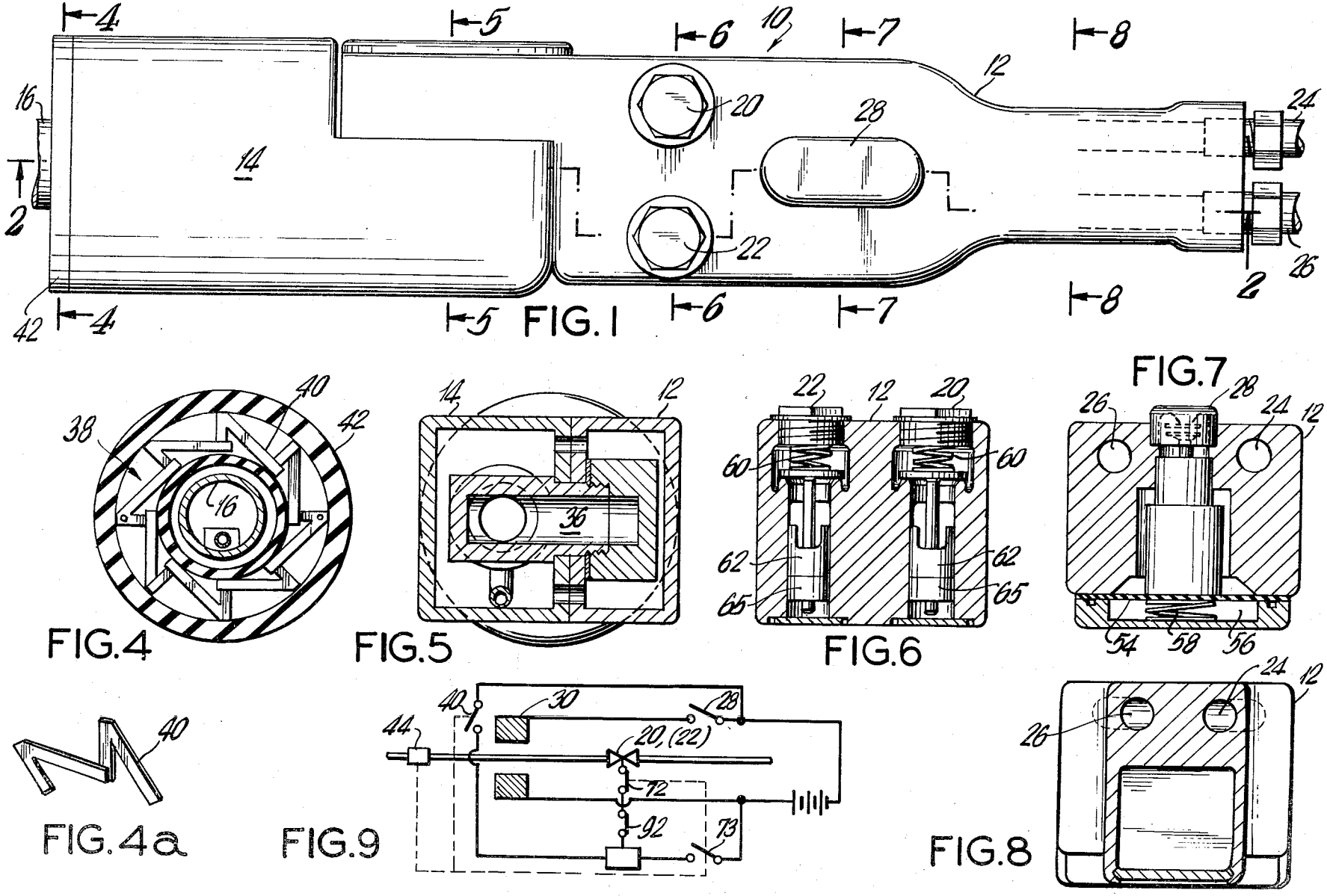
FIG. 1 is a top plan view of a liquid, such as gasoline, dispensing nozzle including optional vapor recovery means, constructed and arranged in accordance with the present invention.
FIG. 4 is a cross-sectional view taken substantially on the line 4—4 of FIG. 1, illustrating details of the no-seal, no flow feature according to the present invention. Also see FIG. 4A.
FIG. 5 is a cross sectional view taken substantially on the line 5—5 of FIG. 1, illustrating the swivel connection between the forward moment arm and rear support portion of the nozzle.
FIG. 6 is a cross-sectional view taken substantially on the line 6—6 of FIG. 1, illustrating the details of the gas and vapor control valves.
FIG. 7 is a cross-sectional view taken substantially on the line 7—7 of FIG. 1, illustrating details of the main switch and automatic shutoff switch.
FIG. 8 is a cross-sectional view taken substantially on the line 8—8 of FIG. 1, illustrating further details of the flow passages of the present invention.
FIG. 9 is a schematic electrical diagram of the various significant features of the present invention.
Figure 10:
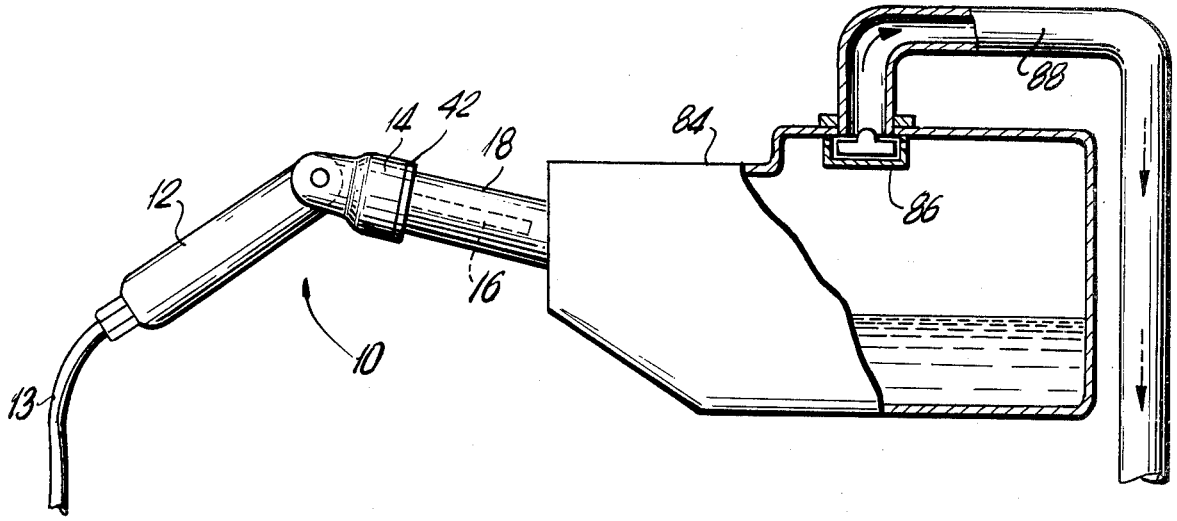
FIG. 10 is a schematic showing the magnetic nozzle according to the present invention with the vapors directed to the on-board vapor handling system.
Figure 13:
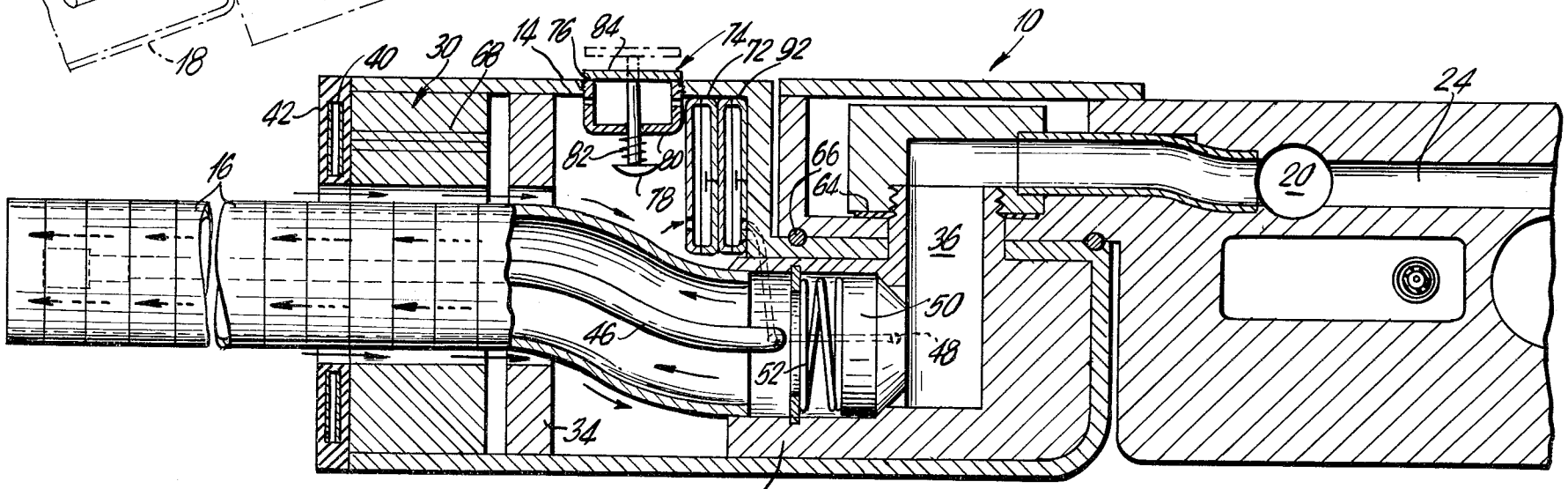
FIG. 13 is a cross-sectional view taken substantially on line 13—13 of FIG. 12.

Referring now to the drawings wherein the same reference numerals are used to designate like parts throughout the several views, there is shown in FIG. 1 a liquid (such as gasoline) dispensing nozzle including optional vapor recovery means. The nozzle generally designated 10 includes a rear portion, which may have or comprise at least part of the handle of the nozzle, connected at its rear most extremity to a typical gasoline dispensing hose 13 (partially shown in FIG. 10) and also has a suitable standard connection at that location if it is desired to recover vapors through the fill nozzle from the tank being filled. The rear portion of the nozzle supports for swinging movement about a pivot or swivel axis a forward torque or moment arm portion 14 which carries the spout 16 for insertion into the fillpipe 18 of the vehicle fuel tank. The outer dimensions of the forward and rear portions are basically the same such that the nozzle presents a relatively uniform elongated shape. A gas control valve 20 and a vapor control valve 22 are provided for cooperation with respective gas and vapor passageways 24 and 26 within the nozzle. Also provided in the rear support housing is a shutoff switch 28 which functions to turn power on and off for the magnet, while power supply switch 73 functions to turn power on or off for the nozzle components. The spout 16 extends centrally outward of the forward portion and is surrounded at the outer end by an annular magnet 30, preferably a permanent magnet. The magnet is radially disposed about the spout and includes an annular space 32 between the magnet and the spout which provides a vapor recovery passageway to be discussed in further detail hereinafter. Mounted at the inner end of the permanent magnet within the forward housing is a keeper plate 34, the function of which also will be described in detail hereinafter. The swivel or pivot axis of the forward housing is shown at 36. At the outermost end of the forward housing and adjacent the outer surface of permanent magnet 30, there is a suitable pressure sensor means 38 for providing an indication as to when the fill spout of the nozzle is properly sealed with respect to the filler neck nozzle mounting surface. This may comprise a simple reedtype contact switch 40 which is radially disposed about the spout as shown in detail in FIG. 4, (also see FIG. 4A) mounting a resilient housing (i.e., rubber) 42 adjacent the magnet. Alternatively, it may comprise other suitable pressure sensor means such as pressure transducers and the like. While the switch is shown extending continuously about the spout, the sensor may be interrupted circumferentially which would suffice for providing an indication as to when a good seal is obtained. The rubber layer 42 can be placed over the sensor means to protect it from damage during handling and to further improve the seal. This switch basically functions such that when there is no seal obtained, for example, when the face of the magnet does not properly seal with the filler neck surface, there is insufficient pressure created by the magnetic force and consequently, contact will not be made in the switch or sensed by the pressure sensor. This causes or prevents the transmission of a suitable signal back to the main circuit so that power is not transmitted to the main fuel valve which prevents fuel flow from passing through the nozzle into the tank. The spout includes a conventional automatic shutoff mechanism so that when the tank has been filled the gas dispensing will automatically cease. This is accomplished by providing the conventional suction sensing opening 44 at the free end of the spout which communicates with a tube 46 which extends back through the gasoline filling spout and communicates with a Venturi opening 48 at an inner end thereof. At that location the opening is provided in a valve member 50 which is spring biased (by means of spring 52) to a normally closed position. In response to the flow of gasoline, the valve in response to the pressure differential permits the gasoline to flow into and through the spout into the tank. The path of the liquid into the tank is illustrated by the outward directed arrows in FIGS. 2 and 3. If it is desired to recover vapors in the supply tank, then the flow path taken by the returned vapors is illustrated by the inward directed arrows in FIGS. 2 and 3. Recovery of vapors also may be effected (as schematically shown in FIG. 10) through other means such as by controllably directing the vapors emitted during refueling to a vapor handling system situated onboard the vehicle. This system will connect with the vehicle's fuel tank 84 and will include, among other things, a canister for absorbing the vapors and thereafter directing them (as shown by the arrows) to other suitable equipment (not shown) on the vehicle for properly disposing of and handling the vapors in accordance with Government regulations. The Venturi opening 48 is associated with the pressure responsive valve 50 and that opening communicates with the further line 53 which coacts with a diaphragm valve shown at 54 in FIG. 2 or a vacuum-actuated electrical switch 92 as shown in FIG. 13. Such a switch is marketed by Micro Pneumatic Logic, Inc. of No. Miami Beach, Florida. The line 53 shown in FIG. 3 enters into an air-tight chamber 56. The diaphragm 54 normally is biased upwardly by means of the spring 58 which causes the locking balls 59 to remain in their upper position (switch open). When the level of the liquid in the tank covers or overlies the suction sensing opening 44 in the spout, then the pressure will be sensed by the diaphragm 54 (via line 53) which moves downwardly in opposition to the spring bias which will trigger by either electrical or mechanical means the main switch 73 to the off-flow position and thereby cause the nozzle flow valve 20 to shut off so that gasoline no longer flows.

The vapor control valve 22 and the gas control valve 20, best illustrated in FIG. 6, are identical and each are basically solenoid-operated in a conventional manner. A typical valve is normally biased into a closed position by the spring 60 and includes a permanent magnet 62 which is normally biased so that the flux flows in a first direction when the valve is closed. When it is desired to open the valve, the flux path is switched to flow in the opposite direction through a keeper 65 which opposes the spring bias tending to maintain the valve closed.

Figure 11:
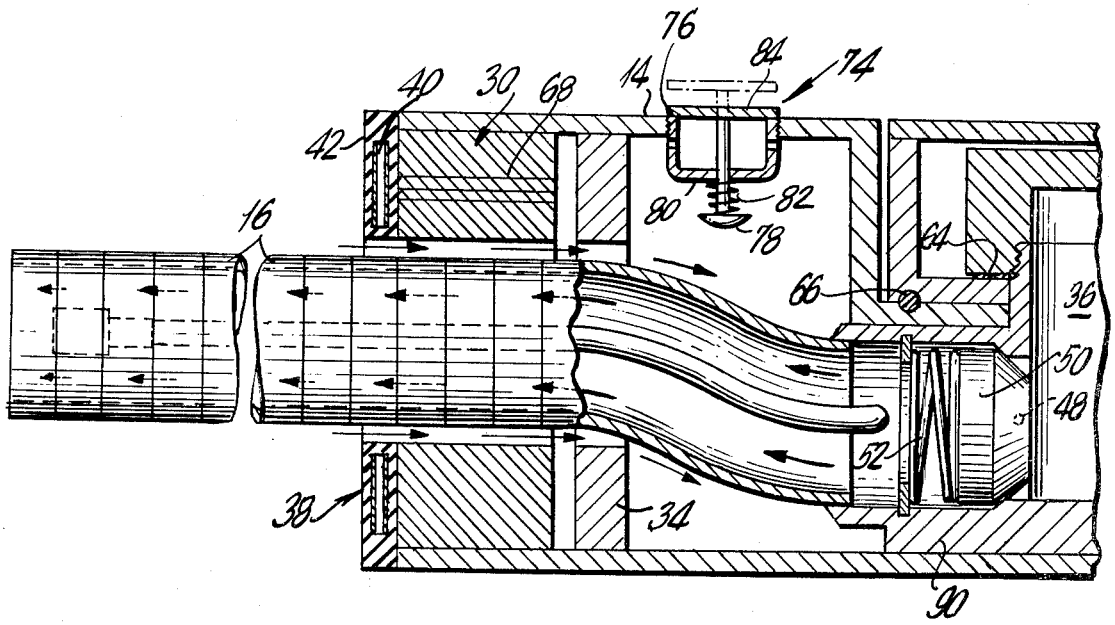
FIG. 11 is an enlarged cross-sectional view of the nozzle according to this invention (similar to FIG. 3) showing another embodiment with an external pressure relief valve and without vapor recovery through the nozzle.
Figure 12:
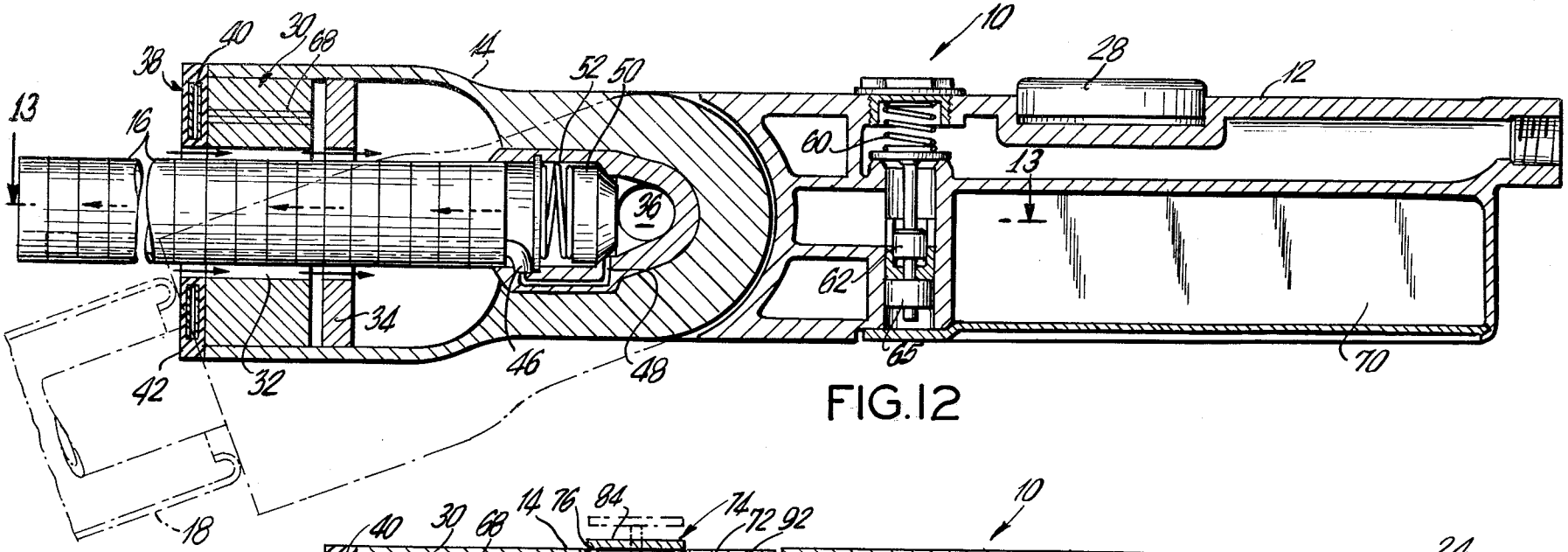
FIG. 12 is an alternate embodiment of the present invention for on-board vapor handling and is identical to the cross-sectional view of FIG. 2 but without vapor recovery through the nozzle.

Another feature of this invention when the vapors are directed away from the nozzle such as to an on-board vehicle vapor handling system is to provide a back-up safety feature in the event that vapor evacuation of the receiver tank is blocked as vapors in the tank are displaced by the fuel. This comprises a pressure-responsive sensor 72 which automatically shuts off the nozzle flow control valves or main shutoff switch 73 when back pressure caused by the vapor blockage is sensed. Sensor 72 can be a Series 500 Pressure Sensor as marketed by Micro Pneumatic Logic, Inc., supra. This is shown in FIG. 13 and illustrated schematically in FIG. 9. An arrangement to relieve excessive pressure is to locate a simple spring-biased valve 74 in the moment arm 14 of the nozzle rearwardly and inwardly of the keeper plate such as shown in FIG. 11. The valve comprises a main body 76 threaded into the arm housing, a stem 78 supporting at its inner or bottom end a valve closure plate 80, and a bias spring 82 mounted about the stem in contact with the plate. The stem is secured at its outer or other end to another closure plate 84 and the spring is disposed between the plates. The valve plates are normally biased closed in seating relation with the valve seats formed in the main body. When the pressure against the closure plates exceeds a predetermined value (e.g. 1.5 psig at a 12 gallon per minute flow rate) above the spring bias force the plates will open by moving outwardly of the housing and provide a release path to the atmosphere for the vapors in case pressure switch 72 fails to respond.

The normally-closed switch 72 can be arranged to open and send a signal to the nozzle liquid flow valve 20 causing it to shut off or to the switch 73 causing it to open and cut off power to the valves. In the nozzle embodiment of FIG. 11 the vapors are prevented from flowing past the nozzle swivel by a partition or similar obstruction 90 on the forward or moment arm side of the swivel. The vapors will collect to some degree in the forward arm chamber and if the normal vapor directing means is not properly operating the vapor buildup will first actuate the pressure switch 72 and then as a safety backup the relief valve 74.

The swivel connection 36 between the forward moment arm 14 of the nozzle and the rear portion 12 is such that the former cannot freely swing in a floppy fashion. Thus, between the adjacent surfaces of the rear and forward portions there is provided a spring wave washer 64 which applies a sufficient frictional bias between the members (see FIG. 3) so that the forward portion swivels in a relatively free but restricted fashion. An O-ring seal 66 is provided at the swivel connection between the relatively movable portions to prevent leakage of vapors into the surrounding atmosphere.

Figure 2:
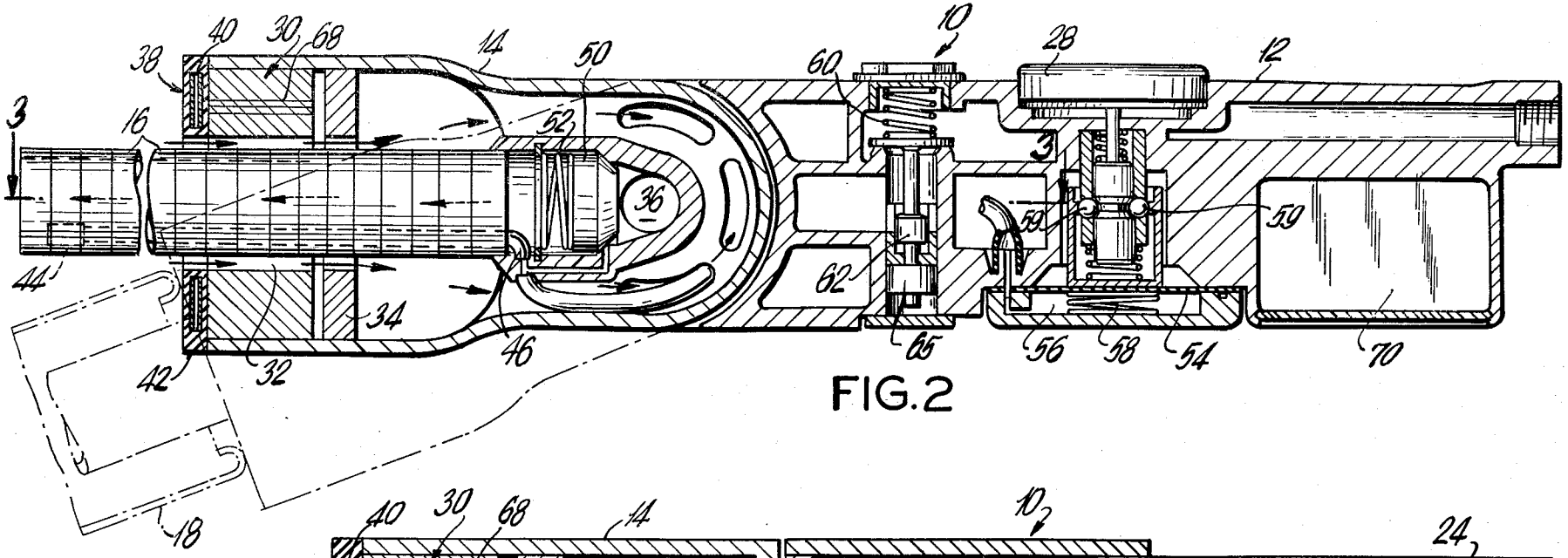
FIG. 2 is a cross-sectional view taken substantially on the line 2—2 of FIG. 1 illustrating details of the nozzle of the present invention and showing the nozzle in dotted lines secured with a vehicle fillpipe.
Figure 3:
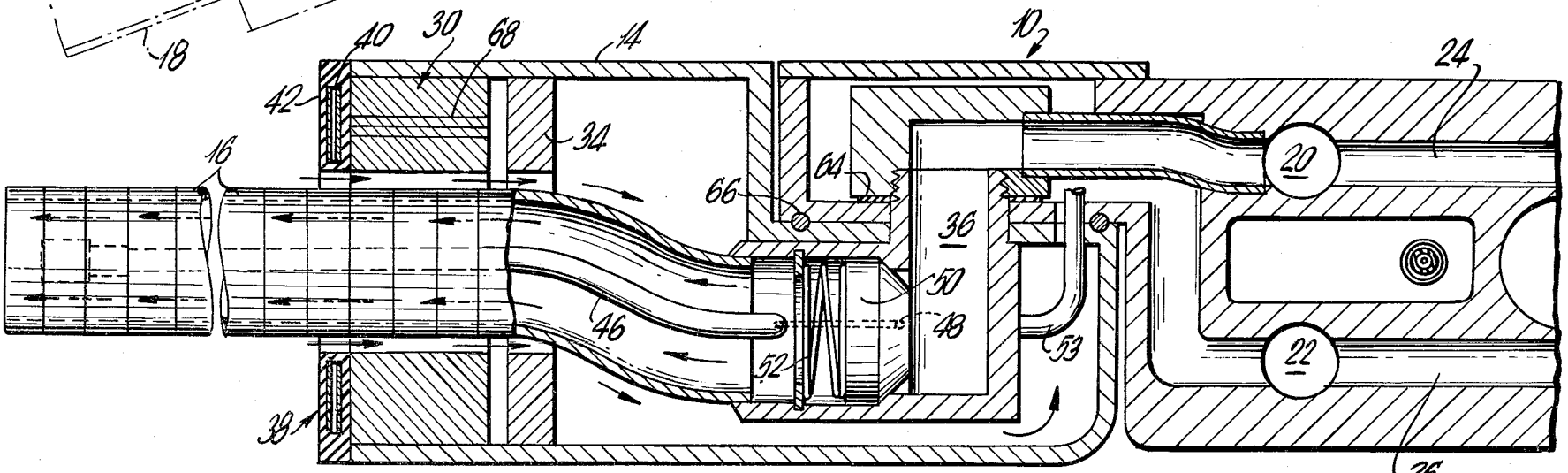
FIG. 3 is a cross-sectional view taken substantially on the line 3—3 of FIG. 2 showing an enlarged view of details of the present invention, particularly the gas and vapor recovery flow paths.

When the nozzle is disposed with its spout 16 in the vehicle fillpipe 18, as shown by the dotted lines in FIG. 2, all of the forces (e.g. turning forces and forces due to hose tension, and hose and nozzle weight) occur at the swivel axis and are translated back to the handle. Thus, the closer that the axis is to the contact surface of the nozzle, the more practical (i.e., smaller) the size of the permanent magnet for use in holding the nozzle in place to the fillpipe. Since the magnet comprises the only holding means for locking and holding as well as sealing the entire assembly with respect to the fillpipe, it is essential that the torque or moment arm not be excessively long and preferably be at least two inches in length. A suitable preferred range is 2 to 6 inches in length, with the most preferred range of 2 to 4 inches. This segmented or articulated arrangement between the forward and rear portions of the nozzle via the swivel effectively reduces the force moment arm which is created by the weight of the nozzle and attached fuel and vapor hoses which act to peel the magnet from the fillpipe. The permanent magnet which would be required in the case of a single non-articulated nozzle would be substantial and too great for holding the entire nozzle and associated components in place. An analysis of the forces developed by the weights of a nozzle and hoses (fuel and vapor) presents an estimate of the support and locking requirements of a magnet. In the situation when the hose drapes to the ground from the vehicle, the forces from the weight of the hoses and nozzle combine to a maximum of approximately 9 pounds. This would tend to be the most severe loading for a magnet since the combined forces tend to peel the magnet when mounted to a fillpipe in the vehicle fender side. In another case with the hose stretched between dispenser (pump) and vehicle, in addition to the weight forces, an added force acts or exists at the nozzlehose tension. However, this hose tension force component is a straight pull on the magnet. Since magnets are strongest in straight pull (all poles are equally supportive) and weakest in peel force modes (forces are concentrated at one or two poles), peel force becomes the critical factor in magnet design. For a magnet to resist a 9-pound peel force, it has been estimated that a magnet must develop a straight attractive force to a vehicle fillpipe in excess of 80 pounds. Attractive forces of this magnitude require a switch control on the magnet flux for ease of nozzle mounting and removal. By locating the swivel relatively close to the nozzle head the swivel acts to reduce the peel forces on the magnet by minimizing the moment arm through which these peel forces act. This permits substantial reduction in required magnet strength with attendant savings in magnet weight and costs.

The permanent magnet is provided with an appropriate standard coil shown schematically in part at 68, which applies the necessary current to alter the path of the flux developed by the magnet. The flux path for the magnet when the nozzle is to be held in place will flow from the magnet 30 into the adjoining surface of fillpipe 18, whereas when it is desired to release or remove the nozzle from the fillpipe the flux path is altered by directing it from the permanent magnet 30 through the overlying keeper plate 34. This switching of the flux paths is accomplished in the same manner as disclosed in U.S. Pat. No. 3,316,514, which is incorporated herein by reference, for details of the magnetic switching from a high attractive force in one mode to a non-attractive mode by using a control winding as described heretofore. Other patents which also relate to this generally known flux control concept are U.S. Pat. Nos. 3,389,356 and 3,389,357.

The magnetic flux control relies on the fact that the permanent magnet material generates a magnetic field at all times. It is possible, through the brief application of an electromagnetic field, to control the direction that the magnetic lines of force take when they leave the permanent magnet material. Less energy is required to control the direction of the field than is required to cancel the field generated by the permanent magnet material. The direction of the permanent magnetic field can be controlled with a pulse of the electromagnetic field, thereby reducing the energy requirements of such a device. In the present nozzle, the permanent magnet field is directed either out the face of the attaching device and into the fillpipe for holding, or into the keeper plate internally disposed of the magnet when the magnet is to relase the fillpipe. The control is designed to require only a pulse of current for field directional control so that no continuous current is required for holding during gasoline filling or when standing idle. Although the basic application of the capability described above is fairly straightforward, the ability to control the permanent material is also based on the capacity of the fillpipe to absorb the magnetic field. Any lines of force not absorbed by the fillpipe will resist the electromagnetic field in releasing the internal keeper from the magnet and thereby resist the redirection of the permanent magnetic field into the fillpipe.

The capability to switch the magnetic flux makes it easy for insertion and release of the nozzle from the vehicle fill neck. Switching can be achieved electrically with an electrical pulse of less than a second, with electrical power supplied by a battery preferably mounted on the nozzle, designed so that voltages and currents are limited to prevent the energy released from an electrical short downstream to be sufficient to ignite pentane or butane atmospheres. The momentary electrical pulse through the magnet coil causes the attraction and/or rejection of the spring mounted floating steel switch plate, the keeper, on the back side of the permanent magnet. The keeper is the only moving part in the magnetic assembly. As explained above, the electrical pulse which attracts the keeper momentarily overcomes the spring forces and causes the keeper to lock onto the magnet, whereupon the magnetic flux of theermanent magnet is directed between poles through the keeper. In this condition, the nozzle is in the release mode since no magnetic flux remains for the magnet to hold onto the vehicle fillpipe. Conversely, when an electrical pulse aided by the springs rejects the keeper, magnetic flux will be directed between magnetic poles through the fillpipe lip. This is the nozzle attachment mode.

The shape of the magnet is basically cylindrical and may include four or more poles. At the forward or outer face of the magnet an alternative arrangement to using the aforedescribed keeper may include providing a rotatable plate including a plurality of circumferentially spaced segments of magnetically soft material which carry but do not retain magnetic flux and also non-conducting segments such as aluminum. When it is desired that the magnet be switched to the off position, the non-conducting segments are indexed manually so that they are located beneath the magnetic poles and thus shield the magnetic flux from the load, i.e. the filler pipe. In the "on" position the magnetically soft conducting material is indexed to be disposed directly below the poles. The basic arrangement employed which uses a permanent magnet and a keeper plate including a multi-segmented cylindrical magnet of the permanent type is disclosed in the aforementioned U.S. Pat. No. 3,389,356.

The no-seal, no-flow feature of the present invention is important for the recovery of vapors displaced by the entering gasoline into the fuel tank. It is important therefore that a tight fit be achieved and maintained between the dispensing nozzle and the vehicle fillpipe. This is insured by the heretofore described sensor 38 located at the outermost face of the nozzle directly adjacent the permanent magnet.

In the rear portion or handle of the nozzle is an area or volume 70 in which suitable power supply can be provided in the form of a battery. This area may be eliminated if an external intrinsically safe power supply is used.

The electrical schematic diagram of FIG. 9 illustrates the overall interaction of the various features of the present invention. The liquid level sensor is situated at the free or filler end of the nozzle for sensing liquid level (via line 53) and is connected back to the automatic shutoff switch 28. The permanent magnet 30 and the no-seal, no-flow pressure sensor 38 are shown situated at the forward end of the nozzle. The vapor and gas valves are shown at 20 and 22, respectively. The main switch 73 is actuated to provide power to the electrically operated components. Switch 28 arranged in circuit with magnet 30 also is closed to supply magnet power. When a tight seal is sensed by 40, then the sensor switch is closed to complete the circuit, also assuming that if the tank is not filled, the liquid level sensor will relay this information back to the automatic shutoff switch 73 which will then be closed. This completed circuit provides power to the vapor and/or gas valves which permits them to be placed in their open or closed position as desired. If switch 73 opens for any reason, power is still supplied to magnet 30 for holding the nozzle in place; however, the valves 20 and/or 22 open to prevent flow. The flux path or permanent magnetic 30 is directed to the left in FIG. 9 (i.e. toward the fillpipe) when the nozzle is to be held in place. The path is reversed toward keeper 34 by means of control coil when the nozzle is to be released from the fillpipe. This is accomplished basically by a pulse of current from the control coil which interacts with the electromagnetic field of the permanent magnet, thus redirecting its flux path from the fillpipe to the keeper plate 34.

FIG. 10 illustrates schematically the magnetic nozzle according to the present invention held onto the vehicle fillpipe in sealed relation such that vapors generated during refueling of the vehicle fuel tank 84 are directed out from the tank through a suitable escape valve 86 and vapor/fuel conduit 88. The conduit, in turn, is connected for directing the vapors to an emission control canister (not shown) and thereafter to the emission handling system on the vehicle.

There has been shown and described an improved gas dispensing nozzle having vapor recovery capability, which has the advantages and benefits described. While a specific embodiment of the invention and certain modifications have been shown and described in detail, it will be understood that inventions may be embodied otherwise without departing from the inventive principles. Various modifications to the invention will be apparent to those skilled in the art without departing from the claims appended hereto.

Having thus set forth the nature of my invention, what I claim herein is:

1. A nozzle assembly for the delivery of liquid from a liquid source to a liquid receiver having a ferromagnetic metal inlet, said nozzle assembly comprising a dispensing nozzle having means for removing vapors which occur during delivery of the liquid to said ferromagnetic metal inlet and including a handle portion pivotally mounted with respect to a forward extending nozzle housing portion having an elongated discharge spout adapted for insertion into said inlet;

vapor collection means operably associated with said spout including a vapor recovery line extending from and through said forward housing portion and said handle portion; and switchable permanent magnet means for producing flux upon activation having an outer suface operably disposed relative to said spout at the end of said nozzle housing portion for releasably holding said nozzle assembly to said ferromagnetic metal inlet being the path of the flux produced by said permanent magnet means being directed in a first direction toward said ferromagnetic metal inlet, means for redirecting the path of flux produced by said magnet means from said first direction when said nozzle assembly is held in place on said inlet to a different second direction generally opposite from said first direction for enabling release of said nozzle assembly from said ferromagnetic metal inlet, and keeper means overlying said permanent magnet means in said nozzle housing portion on the side opposite from said outer surface of said permanent magnet means.

2. The nozzle assembly of claim 1 wherein said magnetic means comprises an annular permanent magnet radially disposed about said spout and said vapor collection means including an annular vapor recovery passageway between said permanent magnet means and said spout in communication with said vapor recovery line, said movably mounted keeper plate means located substantially at the inner end of said permanent magnet means in spaced relation thereto when the path of flux of said magnet means is in said first direction toward said metal inlet and being directly adjacent said magnet means when the path of flux from said magnet means is in said second direction.

3. A nozzle assembly for the delivery of liquid from a liquid source to a liquid receiver having a ferromagnetic metal inlet, said nozzle assembly comprising a dispensing nozzle including a handle portion pivotally mounted with respect to a forward extending nozzle housing portion having an elongated discharge spout adapted for insertion into said inlet; means for directionally controlling vapors which occur during delivery of the liquid to said ferromagnetic metal inlet; and switchable permanent magnet means for producing flux in a desired direction upon activation having an outer surface constructed and arranged so as to be operably disposable relative to said spout at tne end of said nozzle housing portion for releasably holding said nozzle assembly to said ferromagnetic metal inlet when the path of the flux produced by said permanent magnet means is caused to be directed in a first direction toward the ferromagnetic metal inlet means for redirecting the path of flux produced by said permanent magnet means from said first direction when said nozzle assembly is held in place on the inlet to a different second direction generally opposite from said first direction for enabling release of said nozzle assembly from said ferromagnetic metal inlet, and keeper means operably disposed relative to said permanent magnet means in said nozzle housing portion for receiving the redirected flux in said second direction.

4. The nozzle assembly of claim 3 including seal means for providing a seal against vapor and liquid leakage during refueling between said end of said nozzle housing location and the metal inlet.

5. The nozzle assembly of claim 4 wherein said permanent magnet means includes sensor means located adjacent the outer surface of said permanent magnet means for being disposed between the outer surface of said permanent magnet means and said metal inlet to sense when a proper seal exists between said permanent magnet means and the metal inlet and for preventing flow of liquid into the metal inlet in the absence of said proper seal.

6. The nozzle assembly of claim 3 wherein the vapor means comprises vapor collection means comprising an annular vapor recovery passageway between said permanent magnet means and said spout in communication with a vapor line operably disposed in said nozzle housing for recovery of vapor.

7. The nozzle assembly of claim 3 wherein said nozzle housing and said permanent magnet means are constructed and arranged for normally preventing vapors from leaving the inlet of the liquid receiver in the vicinity of said spout.

8. The nozzle assembly of claim 3 wherein said keeper means overlies said permanent magnet on the side opposite from said outer surface thereof.

9. A nozzle assembly for the delivery of liquid from a liquid source to a liquid receiver having a ferromagnetic metal inlet, said nozzle assembly comprising a dispensing nozzle including a handle portion pivotally mounted with respect to a forward extending nozzle housing portion having an elongated discharge spout adapted for insertion into said inlet;

switchable permanent magnet means for producing flux upon activation and having an outer surface operably disposed relative to said spout at the end of said nozzle housing portion for releasaby holding said nozzle assembly in substantially sealed relation to said ferromagnetic metal inlet when the path of the flux produced by said permanent magnet means is directed in a first direction toward said ferromagnetic metal inlet, means for redirecting the path of flux produced by said magnet means from said first direction when said nozzle assembly is held in place on said inlet to a different second direction generally opposite from said first direction for enabling release of said nozzle assembly from said ferromagnetic metal inlet, and keeper means operably associated with said permanent magnet means in said nozzle housing portion for receiving the redirected flux in said second direction.

10. The nozzle assembly of claim 9 wherein said keeper means overlies said permanent magnet means on the side opposite said outer surface of said permanent magnet means.

11. The nozzle assembly of claim 9 including sensor means located adjacent the outer surface of said permanent magnet means for being disposed between the end of said permanent magnet means and said metal inlet to sense when a proper seal exists between said magnet means and said metal inlet and for preventing flow of liquid into said metal inlet in the absence of said proper seal.

12. The nozzle assembly of claim 9 wherein said nozzle housing portion has a length which is relatively short with respect to the length of said handle portion for providing a minimum amount of magnetic force required from said permanent magnetic means for releasably securing said nozzle assembly to said metal inlet.

13. The nozzle assembly of claim 11 wherein said sensor means is housed within a resilient housing directly adjacent the outer end of said permanent magnet means for providing a signal indicative of when a proper seal exists between said nozzle assembly and said metal inlet.

14. A nozzle assembly for the delivery of liquid from a liquid source to a liquid receiver having a ferromagnetic metal inlet, said nozzle assembly comprising a dispensing nozzle including a handle portion and a forward extending nozzle housing portion having an elongated discharge spout adapted for insertion into said inlet;

swivel means for pivotally mounting said nozzle housing portion relative to said handle portion;

switchable permanent magnet means for producing flux upon activation and having an outer surface operably disposed relative to said spout at the end of said nozzle housing portion for releasably holding said nozzle assembly in sealed relation to said ferromagnetic metal inlet with the path of the flux produced by said permanent magnet means being directed in a first direction toward said ferromagnetic metal inlet, means for redirecting the path of flux produced by said magnet means from said first direction when said nozzle assembly is held in place on said inlet to a second direction different from said first direction for enabling release of said nozzle assembly from said ferromagnetic metal inlet, said nozzle housing portion having a length which is relatively short with respect to the length of said handle portion for locating said swivel means relatively close to said outer surface, for providing a minimum amount of magnetic force required from said permanent magnetic means for releasably securing said nozzle assembly to said metal inlet.

15. The nozzle assembly of claim 14 wherein the length of said nozzle housing portion which defines the moment arm of said nozzle assembly is between about 2 and 6 inches.

16. A nozzle assembly for the delivery of liquid from a liquid source to a liquid receiver having a ferromagnetic metal inlet, said nozzle assembly comprising a dispensing nozzle including a handle portion and a forward extending nozzle housing portion having an elongated discharge spout adapted for insertion into said inlet;

swivel means for pivotally mounting said nozzle housing portion relative to said handle portion;

switchable permanent magnet means operable being first release mode and a second attachment mode relative to said inlet, switch means for coacting with said magnet means to place said magnet means in said second attachment mode, for producing flux upon activation in a direction toward said inlet for releasably holding said nozzle assembly to said inlet valve means for controlling the flow of liquid through said nozzle assembly;

sensor means located at the end of said nozzle housing portion adjacent said permanent magnet means for sensing when a seal exists between said inlet and said nozzle housing portion and for closing the liquid flow valve means to prevent liquid flow through said nozzle assembly in the absence of a proper seal;

keeper means operably relative to said permanent magnet means for receiving the flux from said magnet means in said release mode, said switch means also coacting with said magnet means for disposing said magnet means in said release mode.

17. The nozzle assembly of claim 16 wherein said nozzle housing portion is constructed and arranged for directing vapors which occur during the delivery of liquid to said inlet away from said nozzle assembly.

* * * * *